United States Patent [19]

Köbler et al.

[11] Patent Number: 5,058,502

[45] Date of Patent: Oct. 22, 1991

[54] SHORT INKING UNIT

[75] Inventors: Norbert Köbler, Beindersheim; Pirmin Göbel, Erpolzheim; Rudolf Herb, Bobenheim, all of Fed. Rep. of Germany

[73] Assignee: Albert-Frankenthal AG, Frankenthal, Fed. Rep. of Germany

[21] Appl. No.: 607,836

[22] Filed: Oct. 31, 1990

Related U.S. Application Data

[63] Continuation of Ser. No. 147,758, Jan. 25, 1988, abandoned.

[30] Foreign Application Priority Data

Feb. 12, 1987 [DE] Fed. Rep. of Germany ..... 3704433

[51] Int. Cl.[5] ..... B41F 31/04; B41F 31/06

[52] U.S. Cl. ..... 101/363; 101/366

[58] Field of Search ..... 101/363, 350, 364, 366, 101/207, 349, 208–210, 148; 118/412, 413, 410, 258, 259, 261

[56] References Cited

U.S. PATENT DOCUMENTS

| | | | |
|---|---|---|---|
| 2,151,969 | 3/1939 | Henderson | 101/366 X |
| 2,177,656 | 10/1939 | Kaddeland | 101/366 X |
| 3,339,485 | 9/1967 | Rytterholm | 101/363 |
| 3,759,175 | 9/1973 | Alsop | 101/366 |
| 3,899,999 | 8/1975 | Christ et al. | 101/366 |
| 3,987,724 | 10/1976 | Zimmer | 101/366 |
| 4,009,657 | 3/1977 | Bonanno et al. | 101/366 |
| 4,414,900 | 11/1983 | Kraus et al. | 101/364 |
| 4,455,938 | 6/1984 | Loudon | 101/363 |
| 4,590,855 | 5/1986 | Schommer et al. | 101/350 |
| 4,625,643 | 12/1986 | Davis | 101/366 |
| 4,688,516 | 8/1987 | Sommer | 118/413 |

FOREIGN PATENT DOCUMENTS

| | | | |
|---|---|---|---|
| 0062152 | 4/1984 | Japan | 101/366 |

*Primary Examiner*—J. Reed Fisher

*Attorney, Agent, or Firm*—Edwin D. Schindler

[57] ABSTRACT

In the case of a short inking unit with at least one transfer roll in the form of a pitted roll a compact design is made possible together with a reliable and accurate inking effect by the feature that there are at least two doctor blades mutually offset from each other in the peripheral direction of the pitted roll. Both the doctor blades have a negative angle of engagement with the periphery of the roll and delimit an ink chamber in the circumferential direction while the ends of this chamber are shut off by cheekpieces. At the walls of the ink chamber there is at least one supply port to be connected in a pressure-tight manner with an ink supply and at least one overflow port.

11 Claims, 5 Drawing Sheets

SHORT INKING UNIT

This application is a continuation of application Ser. No. 07/147,758, filed Jan. 25, 1988, now abandoned.

BACKGROUND OF THE INVENTION

The invention relates to a short inking unit, and more especially to such an inking unit for use with an offset printing press or at least with a press using a hard printing image carrier and inks with a viscosity generally corresponding to the viscosity of offset printing inks, and having at least one transfer roll in the form of a pitted roll able to be supplied with ink by means of a supply device and having a doctor blade for removing ink from its surface.

A short inking unit of this type is described in the German patent 3,117,341. In the case of this known arrangement the application of ink to the pitted roll with a cooperating single doctor blade is by means of a fountain roll in a fountain. This known arrangement has proved successful but in many cases it requires too much space, since the fountain always has to be so arranged that it fits under the fountain roll and the doctor in order to catch the excess ink.

SHORT SUMMARY OF THE INVENTION

Taking this prior art as a starting point one object of the present invention is to provide an arrangement of the initially mentioned type which is improved by the application of simple and cheap means so that the inking unit may be designed to economize in space.

A still further aim of the invention is to provide such a unit which nevertheless ensures a reliable filling of the pits in the surface of the pitted roll.

In order to achieve this or other objects appearing in the present specification and claims for each pitted roll there are at least two doctor blades offset in relation to each other in the peripheral direction of the pitted roll, such blades being preferably so arranged that both thereof engage the roll with a negative engagement angle at the periphery and which delimit an ink chamber in the peripheral direction, such chamber being shut off by cheekpieces at the ends and adjacent to the inner wall surface of the ink chamber there is at least one supply port able to be connected with an ink source in a preferably pressure-tight manner and at least one overflow port.

These measures lead to the advantage of an integration of the ink supply means with the doctor system, something that means there is a compact design which as regards the location of the individual part parts also involves a high degree of freedom. At the same time the measures of the invention ensure that even at a high operating speed there is a high degree of accuracy. The doctor blade to the rear in terms of the direction of rotation in effect produces a pre-doctoring effect for the removal of the residues in the form of ink on the section of the periphery of the pitted roll returning from the gap between the pitted roll and the inking roll, of water which has made its way into the inking unit, and also of paper dust, the preferably negative engagement angle ensuring operation in a manner which is independent of the speed of the pitted roll and is not interfered with by hydrodynamic effects so that, as a result, there is a clean doctoring action clearing all the film from the roll and a complete removal of all water, something that is able to improve the affinity of the pitted roll for fresh ink and thus improve the degree of filling of the pits in the pitted roll. This in turn has a beneficial effect as regards evening out the flow of ink. A further point is that owing to the pre-doctoring action with a negative engagement angle it is not possible for any interfering solid particles such as dust and the like to find their way under the doctor blade which is to the front in terms of the direction of rotation, and which is responsible for clearing the lands and filling the pits so that it is not generally necessary for the doctor arrangement to be oscillated, something that again simplifies the design. Nevertheless, owing to the negative setting of the doctor the second doctor blade as well and therefore free clearing of the lands, without any interference by hydrodynamic effects, the arrangement ensures that there is a highly accurate metering action. A further advantage of the measures in accordance with the invention is to be seen in the fact that the ink chamber may be supplied with a slight degree of gage pressure, this also leading to a reliable filling of the pits. Owing to the presence of the overflow port however an undesired increase in pressure is prevented right from the start. At the same time this feature leads to a certain circulation of the ink and to a thorough mixing of the old ink with the fresh ink.

In accordance with a further feature of the invention it is possible for the doctor blade which is to the rear in terms of rotation of the pitted roll to be placed over a preferably sloping gutter which is provided outside the ink chamber so that the matter stripped from the pitted roll may be caught and removed.

In keeping with a still further possible feature of the invention the doctor blade which is to rear in terms of the direction of rotation may have at least one overflow port spaced from the edge of the doctor and preferably there are a number of such overflow ports distributed along its length. This measure makes possible a simple design of the doctor holder for the doctor blades. At the same time there is the effect of an intensive mixing of the overflowing ink with the material stripped off the pitted roll so that even in the case of an ink circulation local accumulation of dirt is out of the question.

A further convenient feature of the invention is one in which the two doctor blades are placed in a doctor holder with at least one overflow port arranged between the two doctor blades and there is preferably a plurality of such ports. This leads to a simple design of the doctor blades. Both the doctor blades may then be identical in design.

As part of a further particularly preferred feature of the invention the doctor holder for the two doctor blades may have a distributing chamber extending along its length and having a number of supply holes distributed out along its length. This feature ensures a particularly even filling of the ink chamber along its full length and thus a particularly even supply of ink to the pitted roll.

In keeping with a further development of the invention it is possible for the supply holes to be provided in an inking rail between the two doctor blades so that the holes open into a groove-like pocket in the said rail which is open towards the pitted roll. The longitudinal edges of the inking rail then cause a premetering effect, this facilitating operation of the doctor blade which is to the front in terms of the direction of rotation.

It is convenient if the pocket in the inking rail has a cross section which runs to a point in the direction of rotation of the pitted roll. Owing to the positive slope of the stripping edge resulting from this it is then possible for a comparatively thick ink film to become established on the pitted roll.

In accordance with a further convenient feature of the invention the inking rail is able to be moved like a piston out of the doctor holder, this meaning that there is resilient pressing action and thus an automatic adjustment.

To ensure a further unloading of the doctor blade that is to the front in terms of the direction of rotation the overflow port or ports may be with advantage placed in the part between the inking roll and the front doctor blade.

A further feature of the invention is one in which in order to mount the sealing cheekpieces there is a respective bearer support provided with guide grooves to accept the side edges of the cheekpieces. This feature makes possible a piston-like later adjustment of the sealing cheekpieces. It is furthermore convenient if the guide grooves are open at their ends, this facilitating insertion of the sealing cheekpieces into position.

In accordance with a further feature of the invention the sealing cheekpieces have a counter-support fitting under them at least adjacent to the doctor blade which is arranged to the front in terms of the direction of rotation of the pitted roll. This feature means that there is engagement of the sealing cheekpieces without any clearance and thus an excellent sealing effect at the end.

In order to remove the strip of ink on the pitted roll adjacent to the sealing cheekpieces it is possible for the sealing cheekpieces to have a sloping face which in the direction of rotation forms an acute angle from the outer edge in an inward direction at their corners which are to the rear in the direction of rotation., such sloping face acting practically as a repelling edge.

As a further development of the invention it is possible to have doctor holders each containing an ink chamber and present in a number corresponding to the number of the pressing plates provided along the length of the plate cylinder. This feature facilitates the supply of ink restricted to a certain length of the pitted roll.

The provision of a further ink chamber placed to the front of the ink chamber and which is preferably supplied with overflowed ink coming out of the ink chamber makes it possible for the pitted roll to be inked prior to the time at which it reaches the pre-doctor, this meaning that the pre-doctor is not overloaded even if it has a negative set.

A further feature of the invention is possible in which the doctor blades are not gripped but are loosely mounted in a suitable receiving groove. This ensures that the doctor blades may expand to the side when heated and will not buckle even if there is a comparatively heavy engagement force, this also having a favorable effect as regards the rate of wear.

It is possible to have a preferably driven take-up roll between the two doctor blades so as to engage the pitted roll. This means that circulation of the ink and gage pressure in the ink chamber are no longer necessary and nevertheless ensures a reliable, bubble-free filling of the pits in the pitted roll. The drive of the take-up roll, which is best in the form of a steel roll, is preferably via a gear ring with peripheral recess means to receive a drive pinion connected with a motor.

Further convenient developments and features of the invention will be gathered from the ensuing account of one working example referring to the drawing in conjunction with the claims.

LIST OF THE SEVERAL VIEWS OF THE DRAWINGS

DETAILED ACCOUNT OF WORKING EXAMPLES OF THE INVENTION

Figure 1:
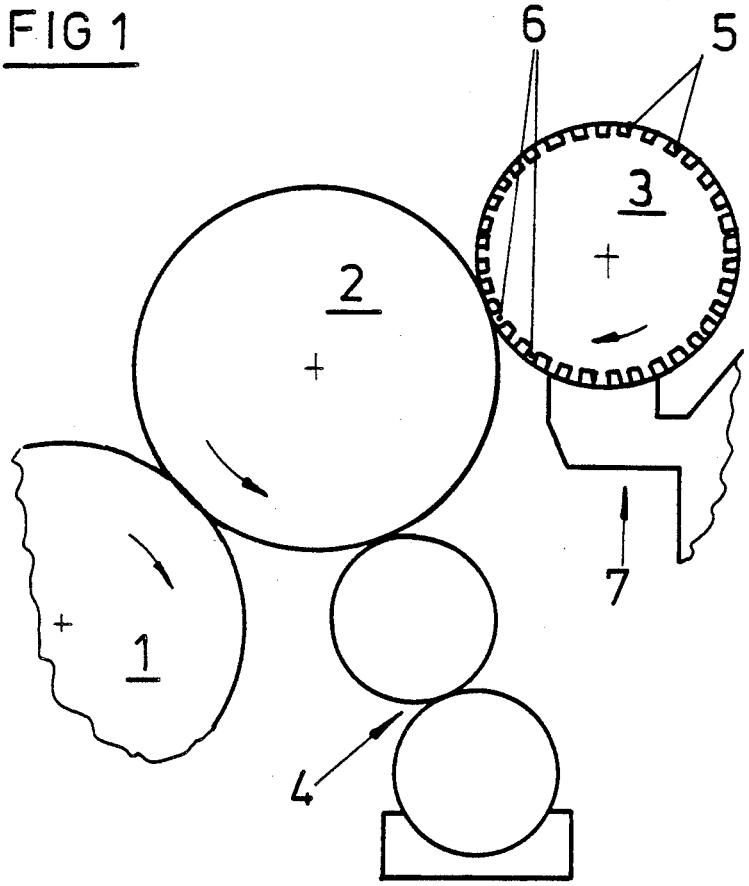
FIG. 1 shows the short inking unit of the present invention for use on a web-feed printing press.

The short inking unit shown in FIG. 12 consists of a rubber-encased inking roll 2 of the same diameter as the plate cylinder 1 with which it cooperates and of a pitted roll 3 having a smaller diameter cooperating with the roll 2. In the case of the offset litho press presently considered the inking roll 2 simultaneously cooperates with a dampening unit generally referenced 4. The periphery of the pitted roll 3 consisting of steel is provided with pits indicated on a larger scale in FIG. 1 which have lands 6 between them. The pits 5 are filled with ink while ink is cleared from the lands 6 by the doctor so as to achieve an accurate metering of the ink in accordance with the capacity of the pits. The ink supply to the pitted roll 3 and the doctoring of the ink therefrom are undertaken by means of the chamber doctor arrangement as shown in FIG. 1 and generally referenced 7. It is possible to have a number of chamber doctor arrangements arranged side by side along the length of the pitted roll, for example two chamber doctor arrangements 7 each occupying half the length of the roll. It would however also be possible to have one chamber doctor arrangement 7 for the full width of each offset plate on the plate cylinder 1. The use of a plurality of chamber doctor arrangements placed side by side facilitates operation of the press and makes it possible to cut off the supply of ink to a given zone of the pitted roll 3.

Figure 2:
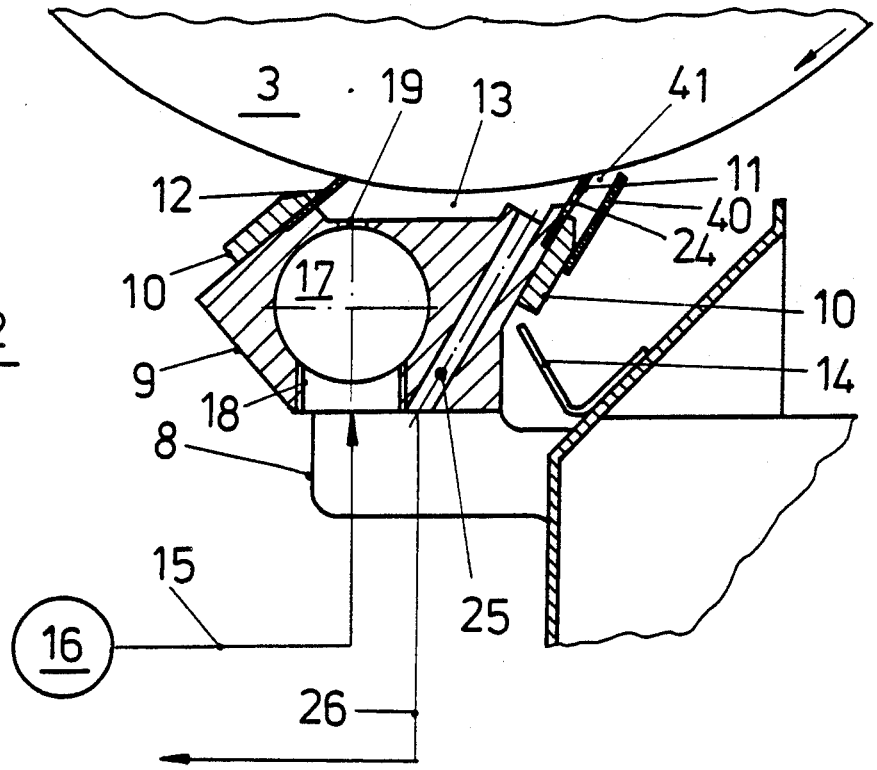
FIG. 2 shows a radial section through a chamber doctor arrangement associated with the pitted roll.
Figure 3:
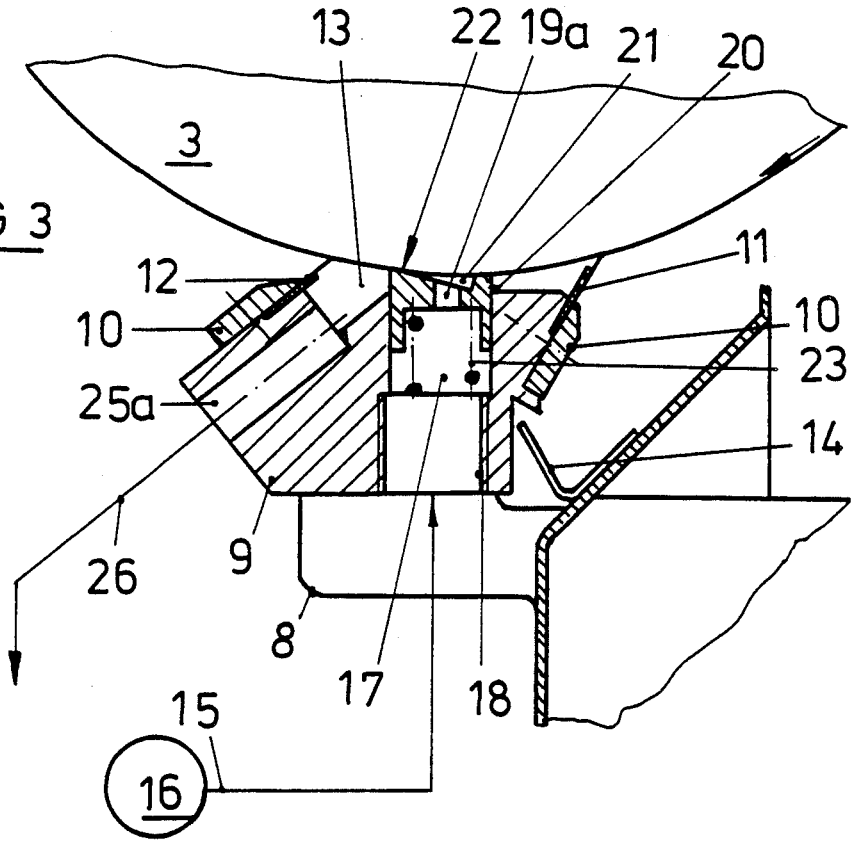
FIG. 3 illustrates a second example in the form of section taken through a chamber doctor arrangement in a view similar to the view of FIG. 1.

As may best be seen from the FIGS. 2 and 3, the chamber doctor arrangement 7 comprises a beam-like doctor holder 9 able to be fitted on carriers 8 fixed to the frame, and on which two doctor blades 11 and 12 are placed which are held by jaws and are offset from each in the direction of rotation. The doctor blades 11 and 12 may be clamped in place with the aid of jaws 10. In the illustrated form of the invention the jaws 10 are to define a holding slot together with the doctor holder 9 so that the doctor blades 11 and 12 may be placed loosely in such slot, that is to say without any clamping effect. For this purpose the said holding slot has a clearance width which is approximately 3/100 mm to 4/100 mm thicker than the thickness of the respective doctor blade for which it is intended. This loose mounting of the doctor blades 11 and 12 ensures that they may expand freely in the longitudinal direction, if the arrangement becomes heated during the course of operation. Owing to this degree of freedom of the doctor blades it is possible to ensure that the doctor blades remain straight even if they are heated. The pressing action of the doctor means on the roll may be accordingly kept comparatively low, and this is an advantage as regards preventing wear. At the same time the loose arrangement of the doctor blades makes it simpler to change the doctor blades.

The doctor blade 11 which is to the rear in terms of the direction of rotation in each case functions as a pre-doctor or preliminary doctor, which strips off residues such as remaining ink, water, particles of dust etc. at the zone of contact returning with the inking roll 2. The residues stripped by the doctor blade 11 are caught by a gutter 14 extending around the blade and set at a slope. The front doctor blade on the roll 3 functions as the main doctor which after inking of the periphery of the pitted roll 3 clears the lands 6. The two doctor blades 11 and 12, which are offset in relation to each other form the limits of an ink chamber 13 to the front and the rear thereof in terms of the direction of rotation, the radial limits of the chamber 13 being formed by the doctor holder 9 and the periphery of the pitted roll 3. At the end the ink chamber 3 is shut off by sealing cheek-pieces which will be described in more detail below.

Figure 7:
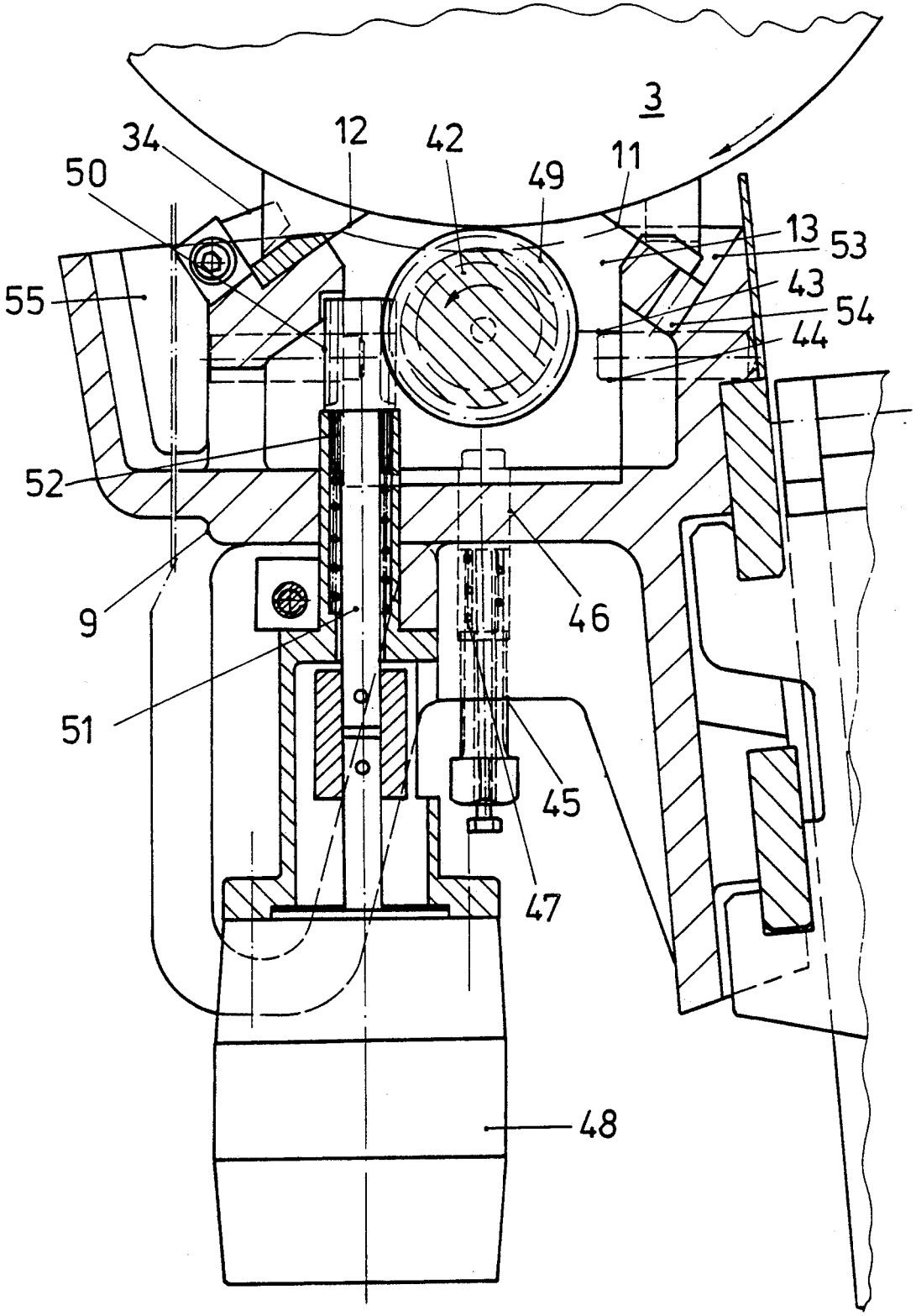
FIG. 7 is a radial section taken through a further working example of the chamber doctor arrangement of the invention with a take-up roll placed between the doctor blades.

If reversibility of the direction of motion of the pitted roll 3 is desired, the doctor blades 11 and 12 may be arranged symmetrically to an imaginary median longitudinal plane in such a manner that, as best seen from FIG. 7, they are inclined towards each other like the two sides of a roof so that in any case the doctor blade operating as the main doctor is set negatively, and it engages the roll in such a way that it defines an obtuse angle with the periphery part further back in the direction of rotation of the pitted roll 3. In the design shown in FIGS. 2 and 3 the two doctor blades 11 and 12 have a negative angle of engagement with the periphery of the pitted roll 3, whose direction of rotation as marked by the arrow is in the present case not able to be reversed. The negative setting of the two doctor blades 11 and 12 ensures that both at the main doctor and also at the pre-doctor there are no undesired hydrodynamic effects even when the pitted roll 3 is running at high speeds. The doctor blade 12 which is to the front in the direction of rotation may be set somewhat more steeply than the rear doctor blade 11 as has been shown by good experimental results.

To ink the pitted roll 3 the ink chamber 13 is supplied with ink. For this purpose the ink chamber 13 in the design of FIGS. 2 and 3 is able to be connected in a pressure-tight manner with a supply line 15, which is here only indicated diagrammatically and runs from an ink pump 16. For this purpose the doctor holder 9 may be provided with a supply hole opening into the ink chamber 13, such hole serving to provide a direct connection between the supply line 15 and the ink chamber 13. It would obviously also be possible to have a plurality of mutually offset supply holes.

In the design shown in FIG. 2 the doctor holder 9 is provided with a distributing chamber 17 formed by an axial hole and which may be connected via an outwardly extending threaded hole 18 (with which the supply line 15 may be connected in a pressure-tight manner) which is able to be supplied with ink and from which a number of supply holes 19 extend which are distributed along the length of the doctor holder 9 and opening into the ink chamber 13. This ensures a particularly even filling of the ink chamber 13 along its full length.

In the case of the design shown in FIG. 3 there is also a distributing chamber 17 accommodated in the doctor holder 9. This chamber is in the form of a groove-like recess in the doctor holder 9, which is shut off on the roll side by a floatingly mounted inking rail 20, which engages the periphery of the pitted roll 3 between the two doctor blades 11 and 12. The inking rail 20 is made with a number of supply holes **19*a* distributed along the length of the rail. These holes open into a pocket 21 extending along the full length and provided in the surface of the inking roll 20. The pocket 21 possesses a cross section which runs to a point in the direction of turning of the pitted roll 3. The edge 22, which is to the fore in the direction of rotation, of the inking rail 20 accordingly acts as a positively set stripping edge, which however owing to the hydrodynamic forces caused by the positive set, allows a thick ink film to move past it. The inking rail 20 arranged floatingly in the recess forming the distribution chamber 17, is able to be moved out like a piston by means of the pressure of the ink acting on its lower surface. In the illustrated form of the invention the outward motion of the inking rail 20 is aided by a spring 23 fitted under it and bearing on the doctor holder 9. The distribution chamber 17 is again accessible from the outside through an outwardly opening connection hole 18**.

The ink pump 16 circulates the ink in which respect the ink has a slight gage pressure in the ink chamber 13 so that the pits 5 are well filled. In order to avoid undesired pressure and in order to ensure circulation of the ink excess ink is run off through one or more overflow ports. These ports may, as is indicated in FIG. 2, be designed in the form of recesses 24 in the rear doctor blade 12 in the form of holes which are spaced from the doctor edge. The excess ink emerging from the recesses 24 is removed via the gutter 14 placed under the doctor blade 11. Additionally or alternatively to the recesses 24 it is also possible for the doctor holder 9 to be provided with one or more overflow holes (of the type indicated in FIG. 2 and 25) which open to the outside and extend past the distribution chamber 17 and the connection hole 18. A pressureless return line 26 may be connected with such holes. The overflow holes 25 are arranged adjacent to the corner which is to be rear in terms of the direction of rotation of the ink chamber 13. In the design of the FIG. 3 with the ink chamber 13 divided by the inking rail 20 there are overflow holes **25*a* formed by outwardly opening holes in the doctor holder 9, which are near the corner (which is to the fore in the direction of rotation of the pitted roll 3) of the ink chamber 13. These holes 25*a* are able to be connected with a pressureless return line 26. The placement of the overflow ports 25*a* in the part adjacent to the doctor blade 12** means that there is less load on this doctor blade.

In order to prevent wear or excessive loading of the doctor blade 11 functioning as a pre-doctor in the arrangement of FIGS. 2 and 3, and which owing to the returning dampening fluid on the pitted roll 3 and the like is subject to more wear, it is possible for the pitted roll 3 to receive ink before engagement with the doctor blade 11 acting as the preliminary doctor, such ink then being immediately stripped off by the doctor blade 11. For this purpose the excess ink emerging from the ink chamber 13 may be used. It is possible in this connection (see FIG. 2) for there to be a sheet metal element 40 placed ahead of the doctor blade 11 and which cooperates in defining an ink chamber 41 ahead of the ink chamber 13 with the doctor blade 11. The excess ink coming via the recesses 24 in the doctor blade from the ink chamber 13 accumulates in the chamber 41 to such an extent here that a pitted roll 3 is inked along its full length. The excess ink emerges through the gap between the sheet metal element 40 and the pitted roll 3 and drips into the gutter 14. In a design in which the doctor blade 11 does not have the recesses 24 shown in FIG. 2 the chamber 41 might also be supplied via slots under the support of the doctor blade 11.

Figure 5:
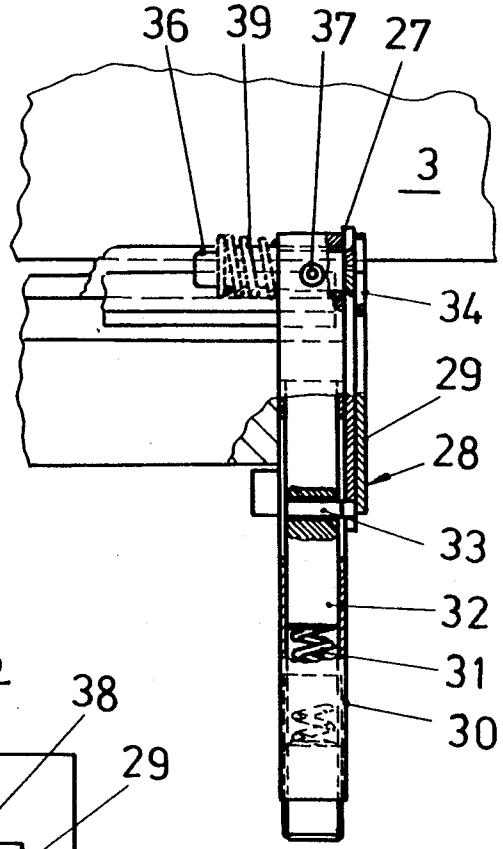
FIG. 5 is a side view of the arrangement of FIG. 4.
Figure 4:
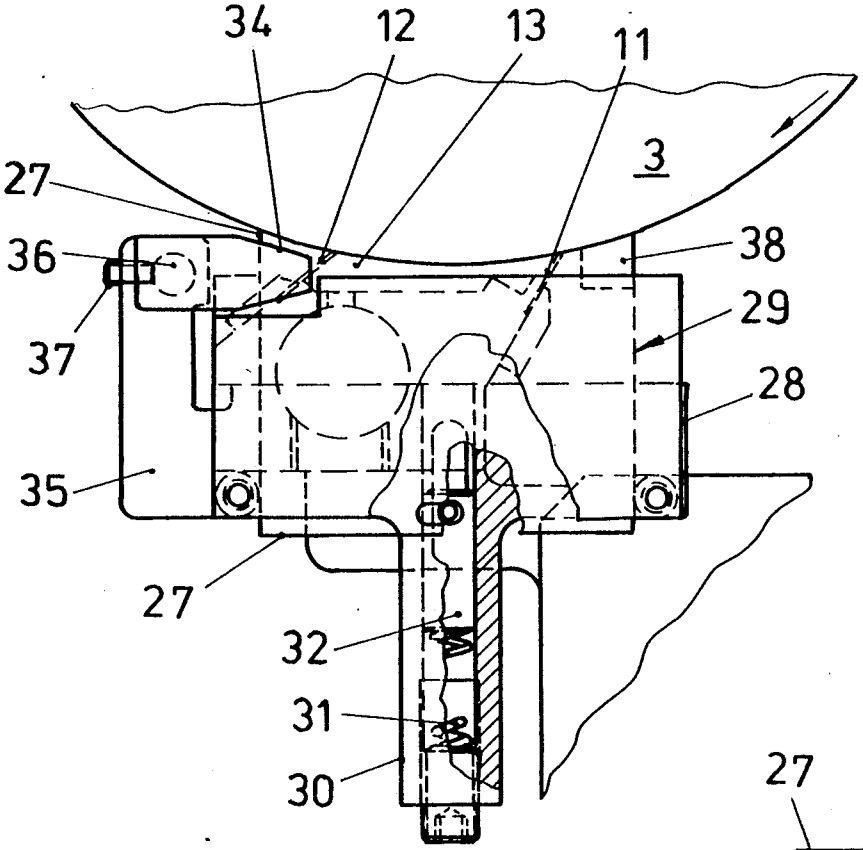
FIG. 4 is an end-on view of the chamber doctor arrangement of the invention.

As will be best seen from the FIGS. 4 and 5, the end sides of the ink chamber 13 are able to be shut off by sealing cheekpieces 27 resting against the periphery of the pitted roll 3. In this respect it is a question of plate-like elements with a concave edge shape corresponding to the periphery of the pitted roll 3. The sealing cheekpieces 27 are in each case received in a bearer support 28 attached to the doctor holder 9 and which is provided with parallel guide grooves 29 to receive the side edges of the sealing cheekpieces 27. The guide grooves 29 are open at the end, i.e. on the side turned towards the pitted roll 3 and also on the opposite side so that the plate-like sealing cheekpieces 27 may readily be pushed in from below in the illustrated form of the invention, this facilitating assembly. The setting of the sealing cheekpieces 27 on the periphery of the pitted roll 3 is with an elastic preloading effect. For this purpose the bearer supports 28 are provided with a piston 32 which is arranged a guide tube 30 arranged generally in the center so that the piston is acted upon by a pretensioned spring 31 under it. The piston acts on the associated sealing cheekpiece 27 from below or, as indicated in the present working example of the invention, is provided with a drive dog 33, which in the present case is in the form of a radial pin extending out of a slot in the guide tube 31. This drive dog 33 fits under the cheekpiece 27 or fits into a recess of the sealing cheekpiece 27.

The sealing cheekpieces 27 are so arranged that their parts protruding from the guide grooves 29 may be pressed onto the ends of the doctor blades 11 and 12. In the illustrated example of the invention there is for this purpose a counter-abutment fitting behind the respective sealing cheekpiece 27 at a position adjacent to doctor blade 12, which is to the front in the direction of turning of the pitted roll 3, and this counter-abutment is adjustably mounted in an associated holding arm 35 of the respective bearer support 28, under which it extends. In the illustrated working example of the invention the counter-abutment 34 is in the form of a simple lug, which is attached to a guide pin 36, which slidingly fits into an associated hole in the holding arm 35 and may be locked in place by means of a clamping screw 37.

It would also be possible to support the counter-abutment 24 by a spring 39 as is indicated in broken lines in FIG. 5. When the doctor blade is replaced this saves having to readjust the counter-abutment 34 and nevertheless guarantees reliable engagement with a preload.

At their corner near to the periphery and to the rear in the direction of rotation of the pitted roll 3, the sealing cheekpieces 27 are provided with an oblique surface 38 (as shown on a larger scale in FIG. 6) extending inwards from the outer edge inwards at an acute angle. This leads practically to a repelling edge, which clears the ink streaks formed on the pitted roll 3 where it is engaged by the sealing cheekpiece 27 and moves such ink inwards into the path of the doctor blades.

Figure 6:
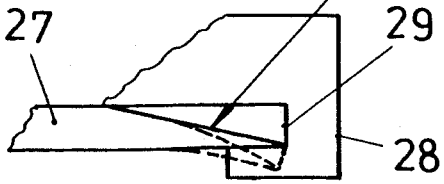
FIG. 6 is a view looking down on the sealing cheekpiece of FIGS. 4 and 5.

Particularly good results are obtained if the point formed by the oblique form or slope 38 is bent approximately 1 to 2 mm in an inward direction, as is indicated in broken lines in FIG. 6.

Figure 8:
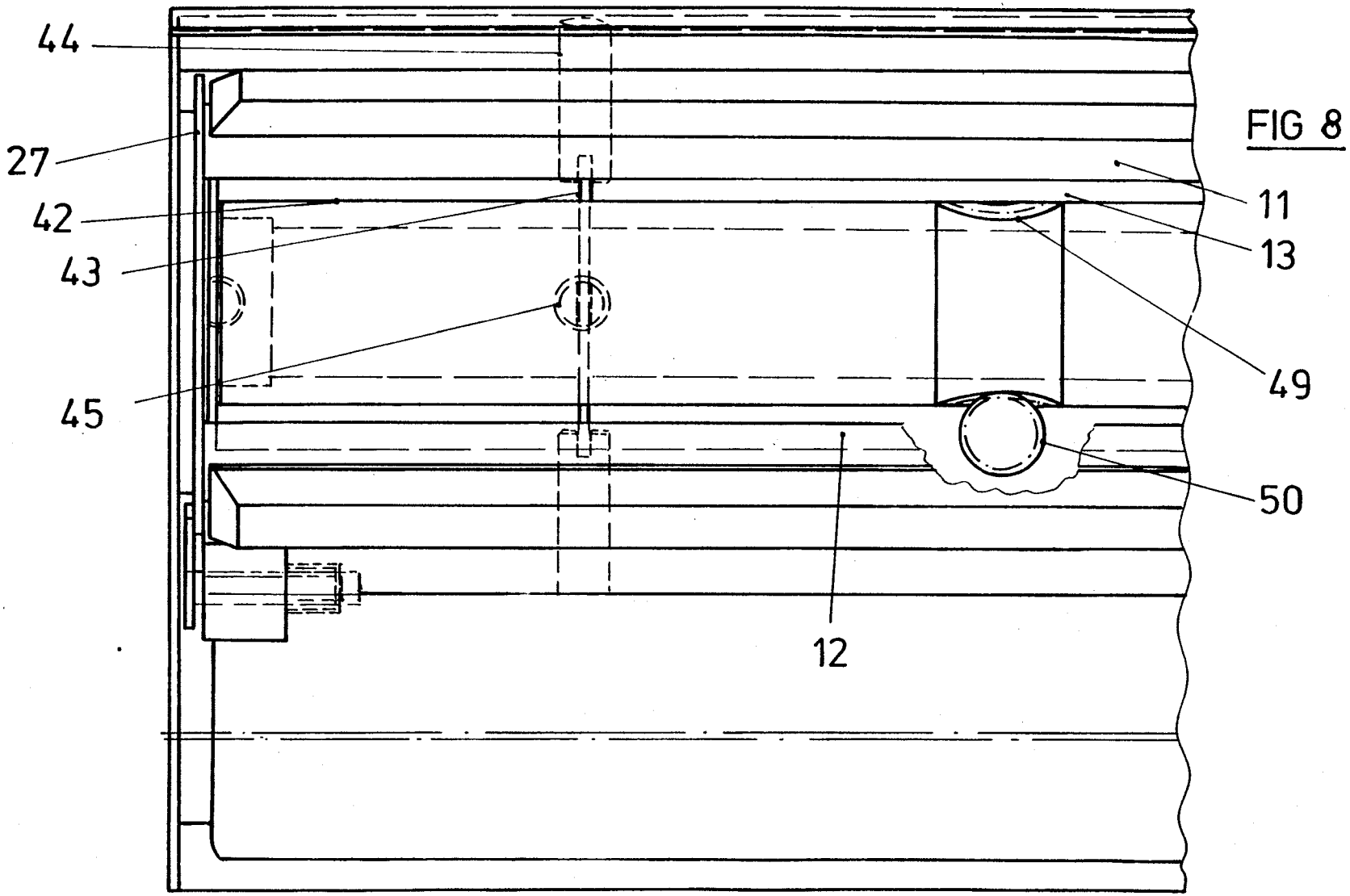
FIG. 8 is a view from above of the arrangement of FIG. 7.

The basie design of the arrangement of FIGS. 7 and 8 is the same as in the above-described arrangement, like reference numerals being used for like parts in the following account.

In the case of this further form of the invention the two doctor blades 11 and 12 are, as noted above in detail and shown in FIG. 7, symmetrically arranged about a median longitudinal plane drawn through the axis of the pitted roll 3 and are sloped towards each other like the sides of a roof. This symmetrical arrangement makes it possible to reverse the direction of turning of the pitted roll 3. The illustrated form of the invention is designed for clockwise rotation of the pitted roll 3. The doctor blade 12 operating as the effective blade thus has a negative set in relation to the pitted roll 3. On the other hand the doctor blade 11 acting as the pre-doctor or preliminary doctor is set positively. The same applies for the opposite direction of rotation. In this case as well the doctor blade which is to the rear in terms of the direction of rotation is set negatively and the doctor blade which is to the fore is set positively.

In the ink chamber 13 delimited by the two doctor blades 11 and 12 there is a take-up roll 42 in the design of FIGS. 7 and 8, which rests on the periphery of the pitted roll 3 for the full length of the ink chamber 13. The take-up roll 42 may be in the form of a rubber or metal roll, and in the illustrated design it is made of steel. The take-up roll 42 ensures that it is not necessary for the ink to be circulated under gage pressure in the ink chamber 13 and that a comparatively small charge of ink in the ink fountain is sufficient. However the take-up roll 42 ensures a reliable and bubble-free filling of the pits of the pitted roll with ink. Owing to the absence of circulation of the ink only a comparatively small amount of ink is used, this being more especially desirable when inking only small areas.

The take-up roll 42 extends along the full length of the respective associated ink chamber 13 so that its end faces, as will best be seen from FIG. 8, rest on the sealing cheekpieces 27. There are half shells 43 set in the ink chamber 13 to support the take-up roll 42 and these shells have the take-up roll 42 placed in them. Like the sealing cheekpieces 27 the half shells 43 are able to be adjusted in the radial direction in relation to the pitted roll 3 so that in any event reliable engagement of the take-up roll 42 on the pitted roll 3 is assured. For this purpose the half shells 43 are guided by slotted pins 44 arranged in the doctor holder 9 and have an externally operated setting screw 45 fitting under them which extends into the ink chamber 13. In the illustrated design in accordance with the invention the setting screw 45 does not directly engage the associated half shell 43 and there is in fact an ejecting pin 46 engaging the half shell 43 which bears on the setting screw 45 via a spring 47.

The take-up roll 42, whose periphery is placed in the half shells 42 is driven by a means of a drive motor 48 in the present example of the invention, which is flange-mounted on the doctor holder 9. The drive motor 48 is reversible so that the take-up roll 42 is able to be so driven in either direction of the pitted roll 3 that there is motion in the same direction at the area of contact and the ink is drawn into the contact nip. The peripheral speed of the take-up roll 42 is however much less than the peripheral speed, which is the same as the web speed, of the pitted roll 3. For driving the take-up roll 42 the same is provided with a worm gear ring arranged about halfway along its length and with a peripheral recess, such worm ring meshing with a worm 50 which is arranged in the ink chamber 13 and which is connected with the drive motor 48 via a shaft 51 extending out of the ink chamber 13. The seal for the shaft 51 is in the form a sealing ring 52 acted upon by a spring and resting on the lower end of the uprightly placed worm 50, such seal ring 52 engaging a tube mounted in the doctor holder 9 and on which the drive motor 48 may be flange-mounted. The drive for the take-up roll 42 via a ring of teeth cut into its periphery is conductive of a simple construction even if there are a number of adjacent ink chambers.

The ink stripped from the pitted roll by the doctor blade 11 operating as a preliminary doctor in the manner of operation shown in FIG. 7 is caught in a groove 53 formed in the doctor holder 9 and is led away. In the illustrated form of the invention the groove 53 is connected via a drain hole 54 with the ink chamber 13 so that the ink removed from the pitted roll 3 is returned to the ink chamber 13. The take-up roll 42 provided in the ink chamber 13 ensures a thorough mixing of the returning contaminated ink with fresh ink. Adjacent to the opposite doctor blade 12, which in the case of opposite rotation of the pitted roll 3 functions as a pre-doctor, there is also a groove connected with the ink chamber 13 so that complete reversibility is ensured. The ink chamber 13 is not held under pressure in the present form of the invention and therefore no ink pump is required. In fact, the ink is able to be poured into the ink chamber 13. For this purpose there is a filling funnel 55 to be seen on the left of FIG. 7 formed in the material of the doctor holder 9 so as to be connected with the ink chamber 13. The present arrangement accordingly operates with a comparatively little ink, something that leads to excellent economies if only small areas are to be printed upon, as for example in the case of pressing for printing additional matter on publications.

We claim:

1. A short inking unit for a printing press designed to operate with an ink having approximately the viscosity of offset printing ink:

at least one pitted roll;

means for supplying ink to said pitted roll;

at least two doctor blades for said at least one pitted roll, said doctor blades engaging said pitted roll with a negatively inclined angle so that said negatively inclined doctor blades form an obtuse angle with a downward-lying segment of the circumference of said pitted roll in the rotational direction of said pitted roll, at least one of said doctor blades being deemed frontal in terms of direction of rotation of said pitted roll and another of said doctor blades being deemed rear in terms of the direction of rotation, said doctor blades further defining an ink chamber in a peripheral direction of said pitted roll, with said doctor blade which is rear in the direction of rotation being provided with a sloping drain gutter outside the ink chamber and said rear doctor blade being further provided with at least one overflow port spaced from an edge of said doctor blade, said rear doctor blade being capable of acting as means for stripping residue ink and dirt particles from said pitted roll;

sealing cheekpieces delimiting ends of the ink chamber; and, a doctor blade holder having at least one inlet port for a connection in a pressure-tight manner with a source of ink and also having at least one overflow port.

2. The short inking unit according to claim 1, wherein said doctor blade which is frontal to the direction of rotation of said pitted roll is set at a steeper angle than said doctor blade which is rearward of the direction of rotation.

3. The short inking unit according to claim 1, wherein said doctor blade holder has a distribution chamber extending along its full length with several supply holes extending from it and spaced out along its length.

4. The short inking unit according to claim 3, wherein the distribution chamber is in the form of an axially extending hole.

5. The short inking unit according to claim 1, further comprising a bearer support with guide grooves to receive lateral edges of said sealing cheekpieces.

6. The short inking unit according to claim 5, wherein said guide grooves are open at both ends thereof.

7. The short inking unit according to claim 1, further comprising a sliding counter-abutment fitting around said sealing cheekpieces, at least partially in a portion thereof adjacent to said doctor blade which is to the front in the direction of rotation.

8. The short inking unit according to claim 7, further comprising a bearer support with guide grooves to receive lateral edges of said sealing cheekpieces, said bearer support being further provided with a holding arm fitting over said counter-abutment in an adjustable manner.

9. The short inking unit according to claim 1, further comprising at least one expelling spring for each of said sealing cheekpieces for moving said sealing cheekpieces outwardly in the manner of a piston.

10. The short inking unit according to claim 1, wherein at a corner near the periphery of said pitted roll, to the rear in terms of the direction of rotation of said pitted roll, said sealing cheekpieces have a sloping face which extends at an acute angle from an outer edge inwardly and is shaped so that a point formed by the sloping surface is outwardly curved.

11. The short inking unit according to claim 1, further comprising at least two pairs of doctors each defining an ink chamber and extending along the length of said pitted roll, said pairs of doctors being present in a number equal to a number of printing plates utilized.

* * * * *